US007758201B2

(12) United States Patent
Hsieh

(10) Patent No.: US 7,758,201 B2
(45) Date of Patent: Jul. 20, 2010

(54) LIGHT ENERGY COLLECTION HAND TOOL

(76) Inventor: Chih-Ching Hsieh, No. 367, Pei Yang Road, Feng Yuan, Taichung Hsien (TW)

( * ) Notice: Subject to any disclaimer, the term of this patent is extended or adjusted under 35 U.S.C. 154(b) by 782 days.

(21) Appl. No.: 11/410,866

(22) Filed: Apr. 26, 2006

(65) Prior Publication Data

US 2007/0253190 A1 Nov. 1, 2007

(51) Int. Cl.
*F21V 33/00* (2006.01)

(52) U.S. Cl. ..... 362/109; 362/119; 362/192; 81/52

(58) Field of Classification Search ..... 362/109, 362/114, 119, 120, 20, 157, 192; 81/52, 81/436, 462, 437
See application file for complete search history.

(56) References Cited

U.S. PATENT DOCUMENTS 6,131,018 A * 10/2000 De Crouy-Chanel et al. ..... 455/572
6,477,921 B1 * 11/2002 Picone ..... 81/170
6,870,089 B1 * 3/2005 Gray ..... 136/251
7,036,952 B2 * 5/2006 Zirk et al. ..... 362/119

* cited by examiner

*Primary Examiner*—Jacob Y Choi
(74) *Attorney, Agent, or Firm*—Ming Chow; Sinorica, LLC

(57) ABSTRACT

A light energy collection hand tool comprises a handle; a driving portion at one end of the handle; and an energy collection plate installed on the handle. The energy collection plate includes a solar energy plate on a surface of the handle, an energy storage unit; and a conductive unit connected to the energy storage unit. A light emitting unit is connected to the conductive unit; and thus electric power flows through the conductive unit will flow through the lighting emitting unit to light up the lighting emitting unit. The light emitting unit is one of a halogens bulb and a light emitting diode device. A slideable cover covers upon the electric power storage area. The metal conductive unit is arranged to be around an inner periphery of the handle; not only transferring electric energy, the conductive unit also generate heat.

1 Claim, 4 Drawing Sheets

LIGHT ENERGY COLLECTION HAND TOOL

FIELD OF THE INVENTION

The present invention relates to hand tools, and in particular to a light energy collection hand tool which has an energy collection device for collection light energy so as to generate heat on the hand tool, which will cause the user feel easy and comfortable and the working efficiency is increased.

BACKGROUND OF THE INVENTION

In the prior art, most of the hand tools are made of metal. It is cool. In winter, the hand tools are especially cool. This will cause that the user feel uneasy as the user hold the hand tool and thus the work efficiency is affected.

To improve above mentioned defect, in some improvements, a plastic cover serves to cover the handle of the hand tool. However the plastic cover cannot firmly secure to the handle so that the force from the user's hand cannot effectively transfer to the screwing object. Thus this cover will affect the working efficiency of the user, even the cover is deserted for holding the handle firmly. Thereby this improvement structure is not practical and not useful.

SUMMARY OF THE INVENTION

Accordingly, the primary object of the present invention is to provide a light energy collection hand tool which has an energy collection device for collection light energy so as to generate heat on the hand tool, which will cause the user feel easy and comfortable and the work efficiency is increased.

To achieve above objects, the present invention provides a light energy collection hand tool which comprises a handle; a driving portion at one end of the handle; and an energy collection plate installed on the handle. The energy collection plate includes a solar energy plate on a surface of the handle, an energy storage unit; and a conductive unit connected to the energy storage unit. A light emitting unit is connected to the conductive unit; and thus electric power flows through the conductive unit will flow through the lighting emitting unit to light up the lighting emitting unit. The light emitting unit is one of a halogens bulb and a light emitting diode device. A slideable cover covers upon the electric power storage area. The metal conductive unit is arranged to be around an inner periphery of the handle; not only transferring electric energy, the conductive unit also generate heat.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
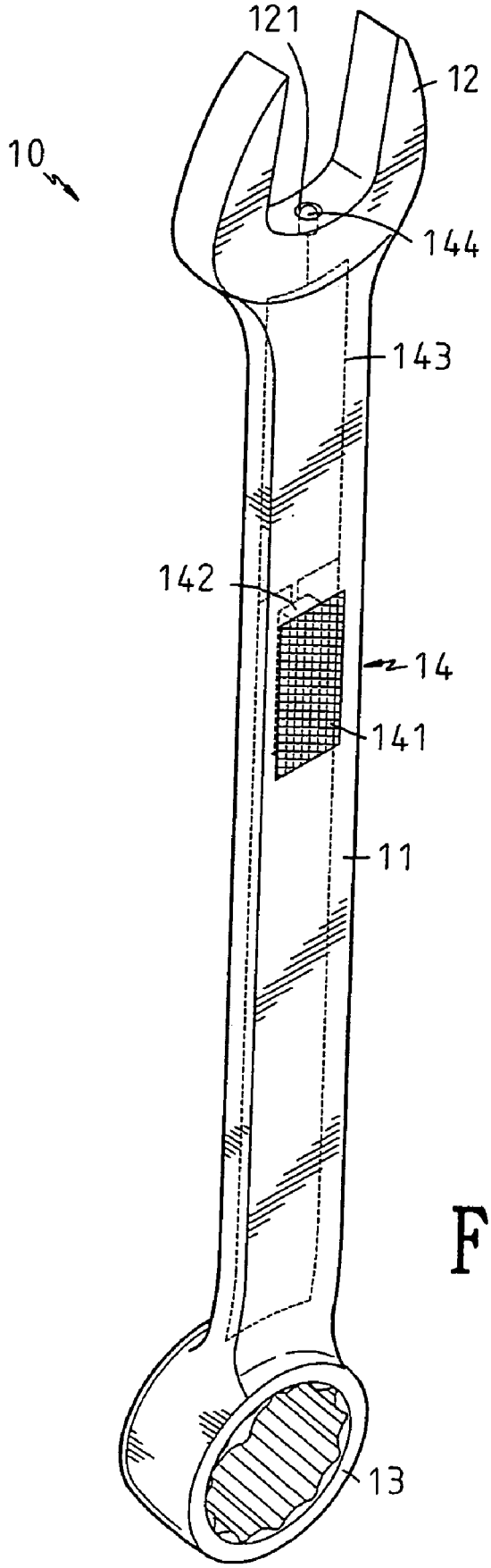
FIG. 1 is a structural perspective view of the light energy collection hand tool of the present invention.
Figure 2:
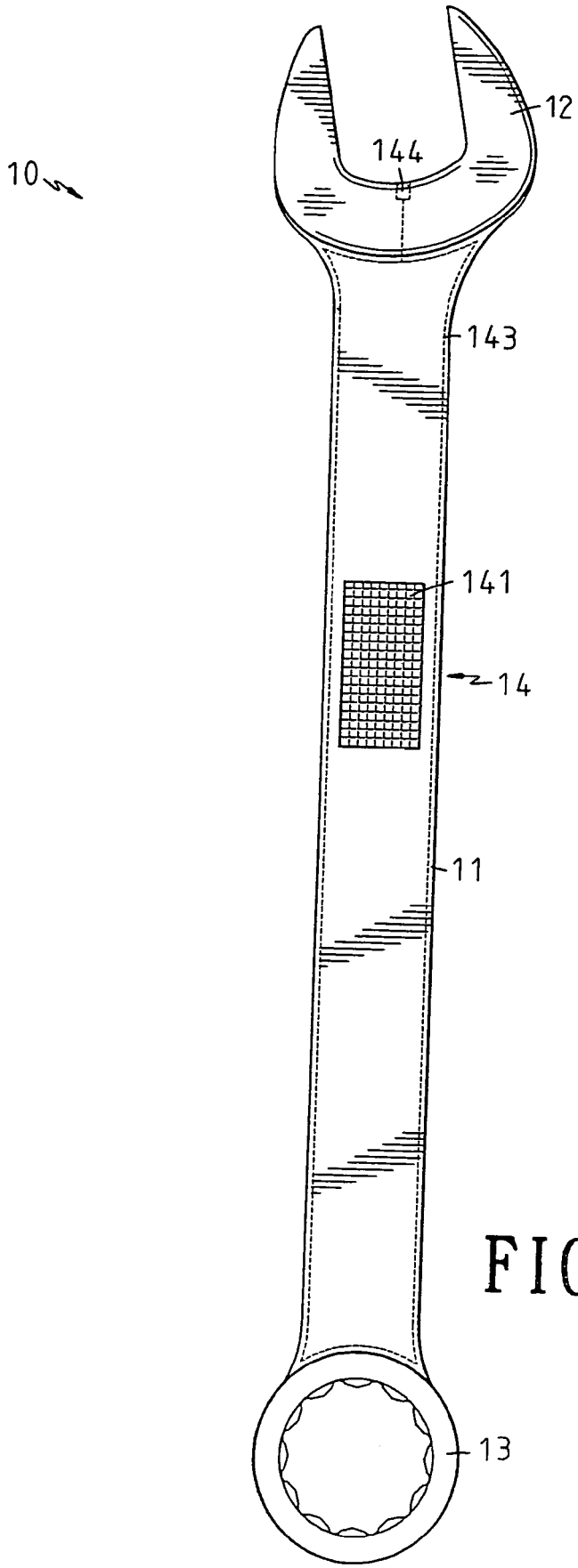
FIG. 2 is a front perspective view of the light energy collection hand tool of the present invention.
Figure 3:
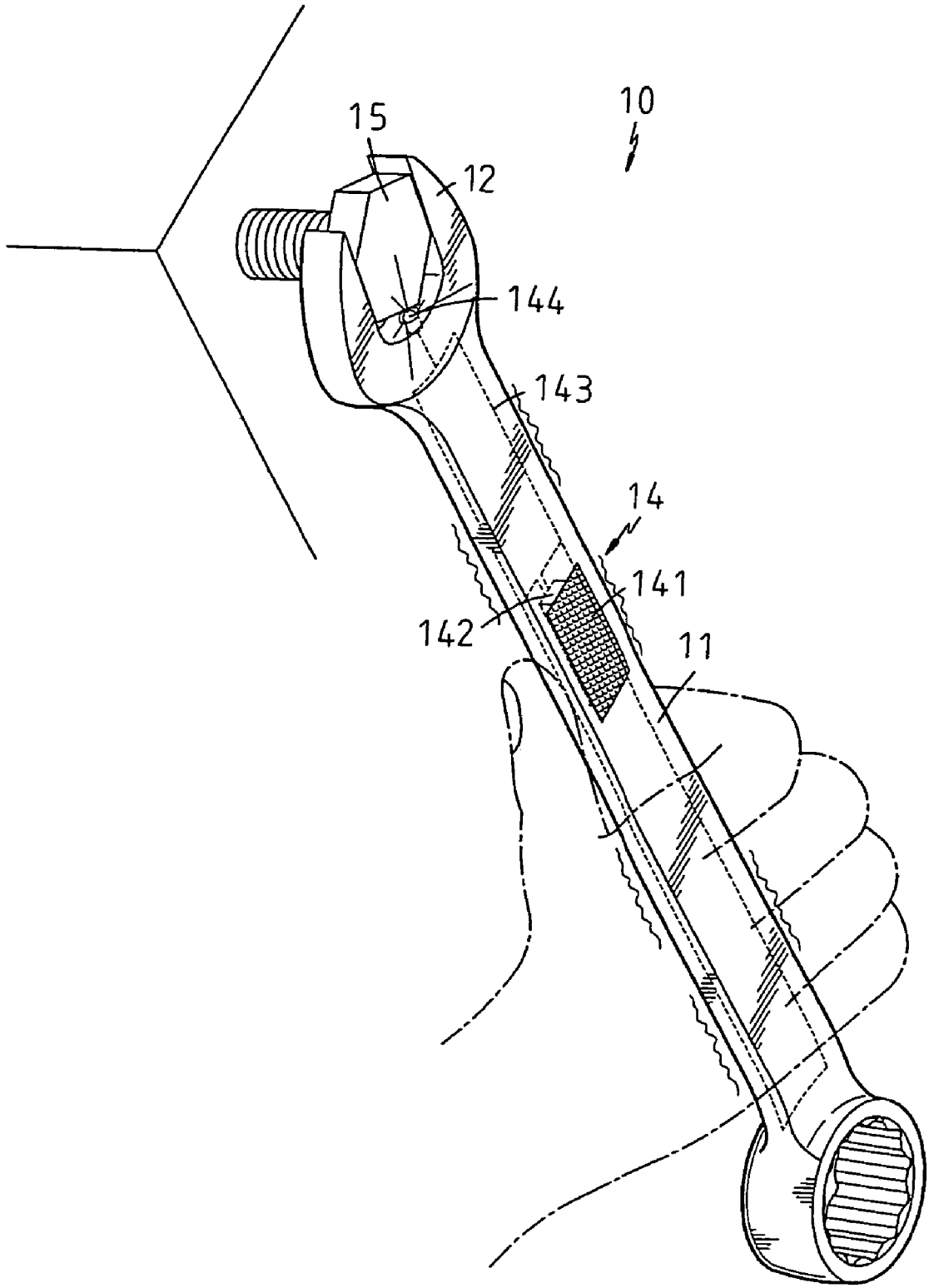
FIG. 3 is a schematic view showing the operation of the present invention.

Referring to FIGS. 1 to 3, the present invention is illustrated. The present invention has the following elements.

A handle 11 is included. One end of the handle 11 has a first driving portion 12 which has two jaws. An open space is formed between the two jaws. Another end of the handle 11 is formed with a second driving portion 13 which is a ring with inner teeth. An energy storage unit 14 is installed at one surface of the handle 11. The energy storage unit 14 is formed by a spanner body 10, an electric power storage area 142 and a conductive unit 143.

The solar energy plate 141 serves for absorbing solar energy which are then converted into electric energy. The electric energy is stored in the electric power storage area 142. The electric power storage area 142 serves for storing electric energy. The power in the electric power storage area 142 is transferred out through the conductive unit 143 distributed in the handle 11.

The metal conductive unit 143 is arranged to be around an inner periphery of the handle 11. Not only transferring electric energy, the conductive unit 143 also generate heat. Thus, the user can hole the spanner comfortably instead of holding a cool spanner.

At least one of the first driving portion 12 and the second driving portion 13 is formed with a receiving hole 121. In this embodiment, the first driving portion 12 is formed with the receiving hole 121. A light emitting unit 144 is for example a halogens bulb or light emitting diode device. Thus electric power flowing through the conductive unit 143 will flow through the lighting emitting unit 144 to light up the lighting emitting unit 144. Thus the hand tool can be used in the dark.

Figure 5:
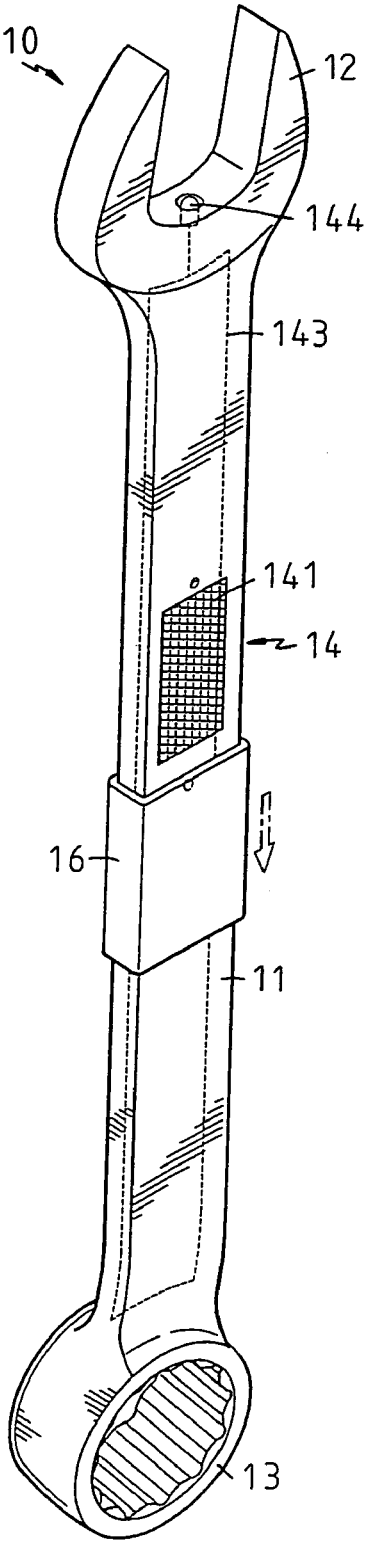
FIG. 5 is a schematic view showing the operation of the sliding cover of the present invention.
Figure 4:
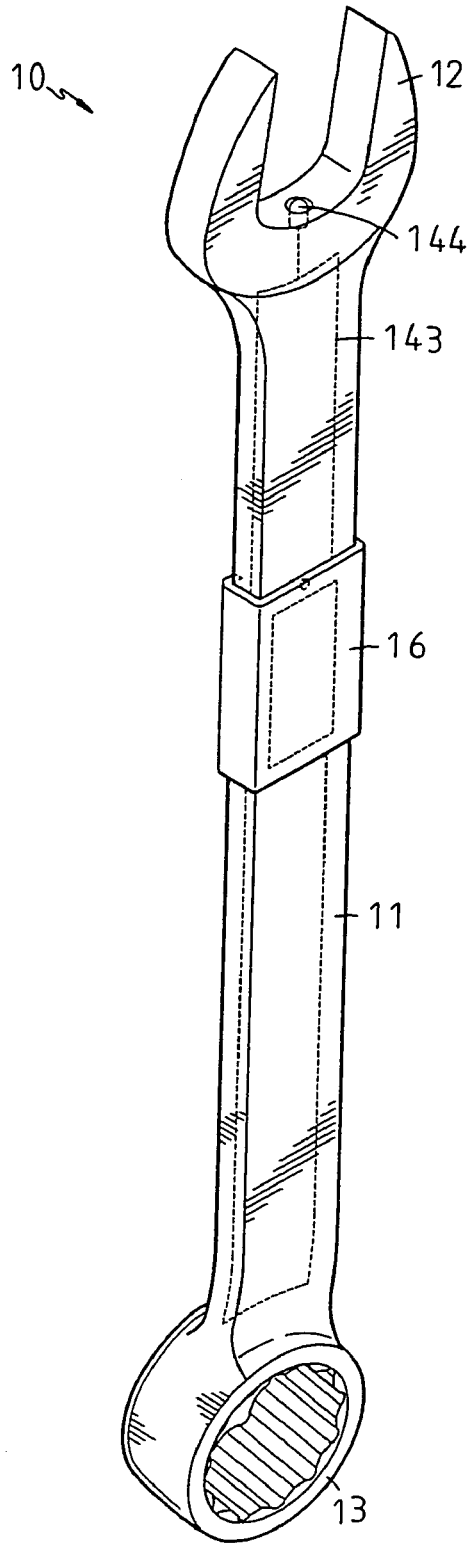
FIG. 4 is a schematic view showing the second embodiment of the present invention, wherein a sliding cover is applied to the hand tool of the present invention.

Referring to FIGS. 4 and 5, the second embodiment of the present invention is illustrated. Those identical to the first embodiment will not be described. Only those differences are described. It is illustrated that a slideable cover 16 covers upon the electric power storage area 142.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A handtool with light and energy collection comprising:

a handle with two ends;

a driving portion is formed at at least one of the two end of the handle;

an energy collection plate being installed on the handle;

the energy collection plate comprises of a solar energy plate;

the energy collection plate being fixed on a surface of the handle;

the energy collection plate generates electric power;

an energy storage unit being installed in the handle;

a conductive unit being installed in the handle and connected to the energy storage unit; and a light emitting unit being fixed at the driving portion and being connected to the conductive unit;

the electric power flows through the conductive unit to the lighting emitting unit.

* * * * *